US007063269B2

(12) United States Patent
Molyneux

(10) Patent No.: US 7,063,269 B2
(45) Date of Patent: Jun. 20, 2006

(54) RAIL SUPPORT PLATE AND RELATED SYSTEM

(76) Inventor: Godfrey Matthew Owen Molyneux, 321 Squire Cir., Pittsburgh, PA (US) 15212

( * ) Notice: Subject to any disclaimer, the term of this patent is extended or adjusted under 35 U.S.C. 154(b) by 756 days.

(21) Appl. No.: 09/920,918

(22) Filed: Aug. 2, 2001

(65) Prior Publication Data

US 2002/0017215 A1 Feb. 14, 2002

(51) Int. Cl.
*E01B 3/12* (2006.01)

(52) U.S. Cl. ..... 238/287
(58) Field of Classification Search ..... 238/287, 238/292, 310
See application file for complete search history.

(56) References Cited

U.S. PATENT DOCUMENTS 1,075,312 A * 10/1913 Remer
3,576,293 A * 4/1971 Landis et al. ..... 238/287
4,316,578 A * 2/1982 Reynolds et al. ..... 238/283
5,449,116 A * 9/1995 Bruning ..... 238/295

* cited by examiner

*Primary Examiner*—S. Joseph Morano
*Assistant Examiner*—Robert J. McCarry, Jr.

(57) ABSTRACT

A rail support plate for use in a rail support system. The plate has an open slotted hole on one side and a hole on its other side. This plate is placed over a set of opposed holes in a support structure. One of these opposed holes has a fixedly secured anchor bolt that can be easily engaged by the open slotted hole of the plate. A securing bolt is inserted into the hole of the plate and into the aligned hole of the support structure. This arrangement permits easy removal and/or addition of a rail support plate from underneath a rail without the need to remove the rail from the support structure. Several rail support plates can be used along the length of the rail whereby the anchor bolts are arranged in a staggered pattern relative to the other.

5 Claims, 8 Drawing Sheets

RAIL SUPPORT PLATE AND RELATED SYSTEM

BACKGROUND OF THE INVENTION

1. Field of the Invention

The present invention relates to a rail support system. More particularly, the present invention relates to a rail support system used by cranes that run on rails and to a rail support plate that is positioned under the rail.

2. Background Art

A crane generally runs on rails that rest on support plates. The rail support plates typically have holes to enable the positioning of the rail support plate over threaded anchor bolts that are fixedly secured into a support structure, which, in turn, supports the rail system. In order to adjust the rail, several rail support plates of varying thickness generally are installed onto the same anchor bolts. If a rail support plate needs to be added and/or removed from beneath the rail, the rail needs to be raised above the top of the anchor bolts so that the rail support plate can be installed or removed. To avoid disturbance of the rail's placement, it is customary to position shims under the rail. These shims are not retained by the anchor bolts but are frictionally held in place underneath the rail by the rail and perhaps the rail support plates. Since these shims are frictionally held in place, they easily become dislodged. This then requires constant repositioning of the shims.

There is therefore a need in the art to provide a rail support plate for adjusting the elevation of the rail after the rail has been lowered into position on the rail support plates.

There is also a need in the art to provide a rail support plate or plates that can be easily withdrawn from under the rail after the rail support plate or plates have been installed without requiring the removal of the rail.

SUMMARY OF THE INVENTION

The invention has met the above needs. The invention provides for a rail support system that comprises a plurality of rail support plates that can be used to adjust the elevation of the rail after the rail has been lowered into position onto the rail support structure.

The rail support structure has a plurality of sets of two-opposed holes wherein one of the holes contains a fixed threaded anchor bolt and the other hole receives a securing bolt. Each of the two-opposed holes of each set is located on an opposite edge of a rail. The rail support plate has an open slotted hole on a first side for engagement around the anchor bolt and a hole or an open slotted hole on a second side for alignment with a corresponding hole in the support structure and for receipt of the securing bolt.

The rail support plates are positioned along the length of the rail and underneath the rail in a selective spaced relationship relative to each other. When the plates are in this position, the anchor bolt of each rail support plate is arranged in a staggered relationship relative to each other along the length of the rail.

The thickness of each rail support plate may vary and several rail support plates of the same or varying thickness can be positioned beneath the rail.

It is therefore, an objective of the present invention to provide a rail support plate that can be easily installed or removed from underneath a rail without lifting the rail above the anchor bolt used to secure the rail support plate or plates to the support structure.

It is a further objective of the present invention to provide a unique design for a rail support plate comprising an opened slotted hole located on a first side and either an opened slotted hole or a hole located on a second side of the rail support plate.

These and other objectives and advantages of the present invention will be better appreciated and understood by those skilled in the art from the following drawings, description and appended claims.

DETAILED DESCRIPTION OF THE INVENTION

Figure 1:
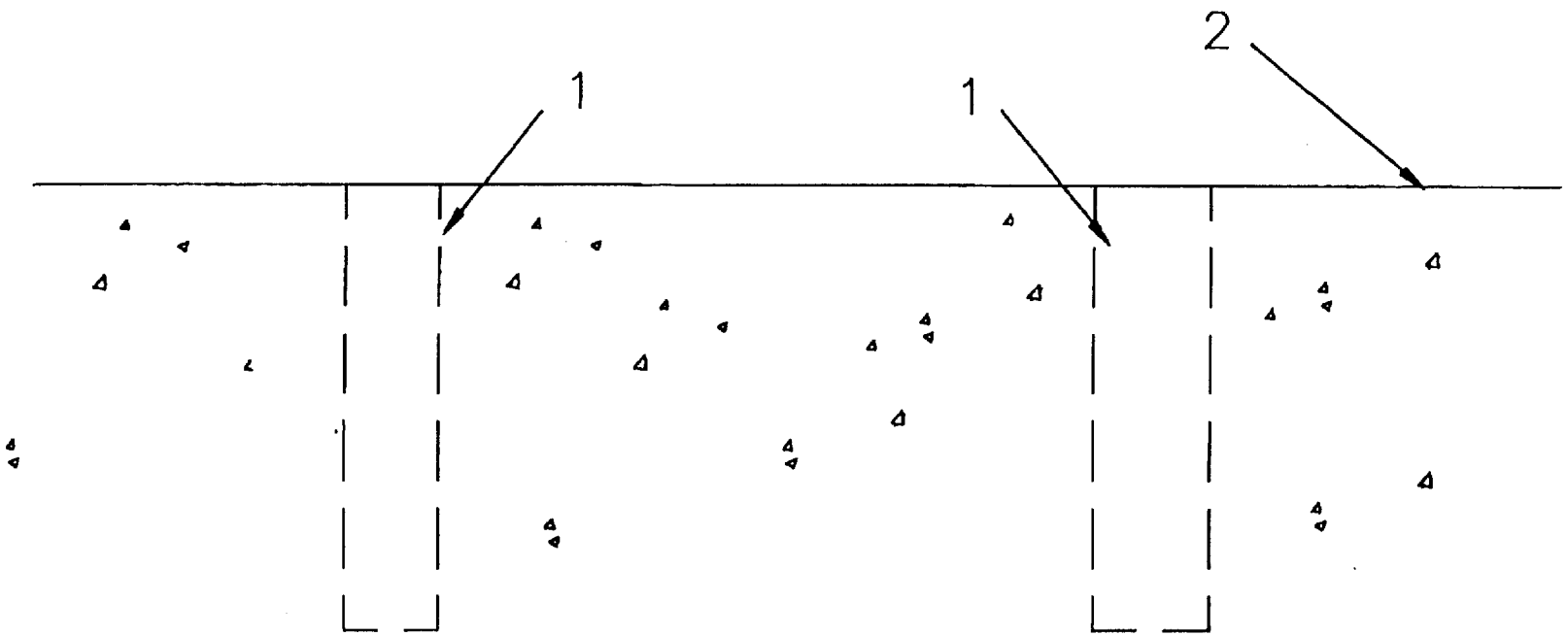
FIG. 1 is a sectional, elevation view showing drilled holes in a concrete structure of the invention.
Figure 2:
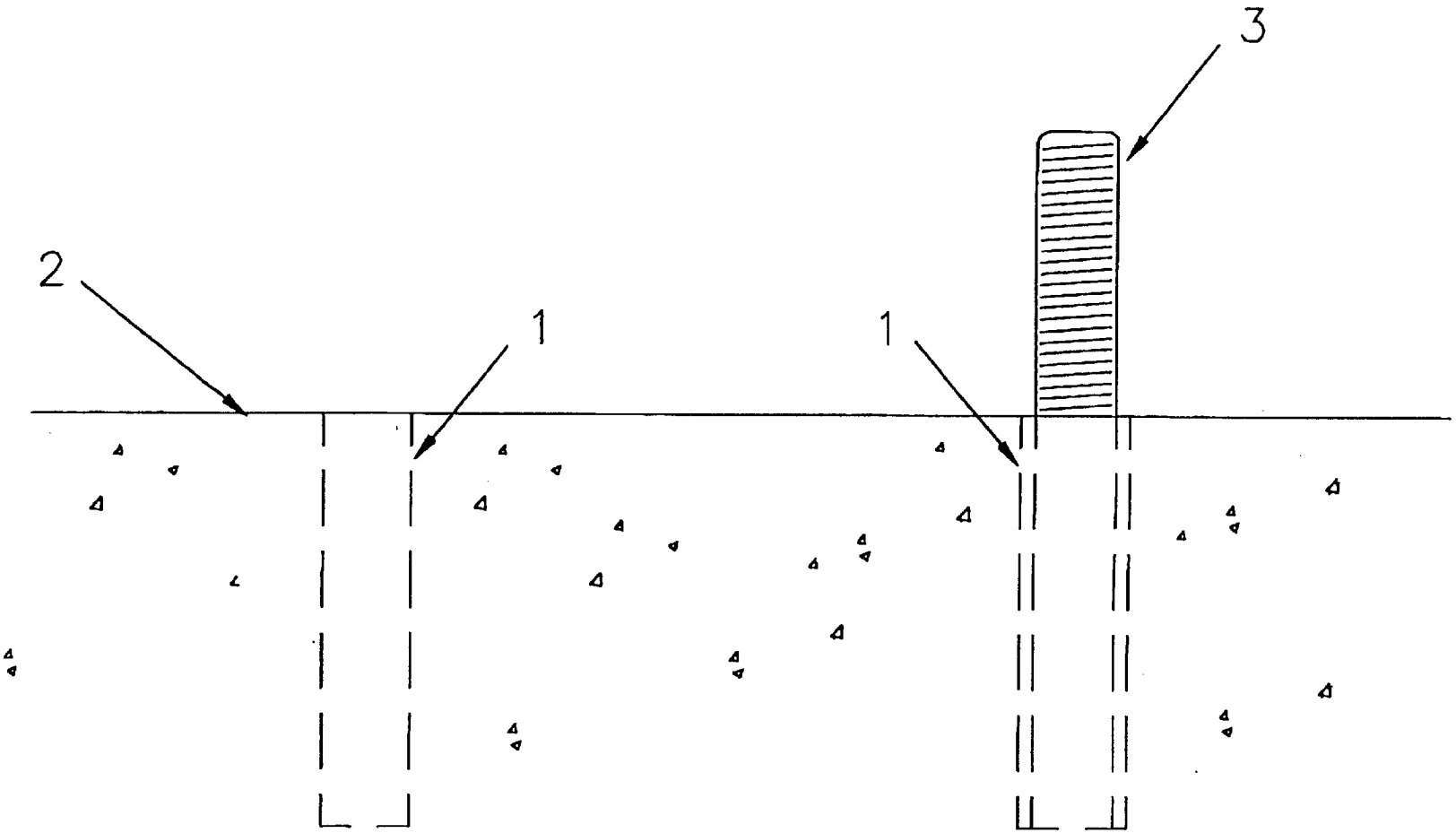
FIG. 2 is a view similar to FIG. 1 showing a threaded anchor bolt of the invention.

Referring to FIGS. 1 and 2, drilled holes 1 are in a concrete support structure 2. The drilled hole 1 located to the right of FIG. 2 receives a threaded anchor bolt 3, which is permanently secured in drilled hole 1 with a bonding material, such as an epoxy resin or grout or with expansion anchors (not shown). The drilled hole 1 located to the left of FIGS. 1 and 2 is generally left open to receive a threaded securing bolt, more about which will be discussed herein below.

The several anchor bolts 3 and open holes 1 of the rail support system can be cast into the concrete at the time the concrete is poured to form concrete support structure 2.

Figure 4:
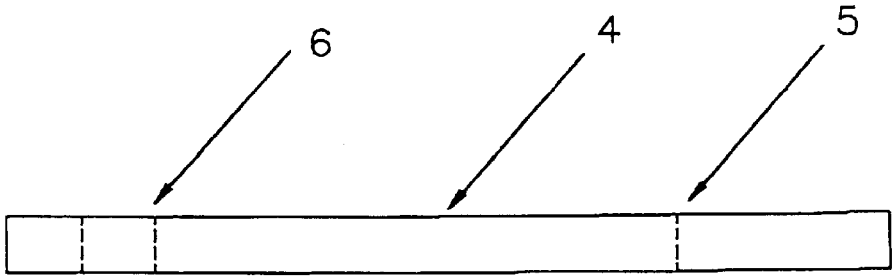
FIG. 4 is a side view of FIG. 3.
Figure 3:
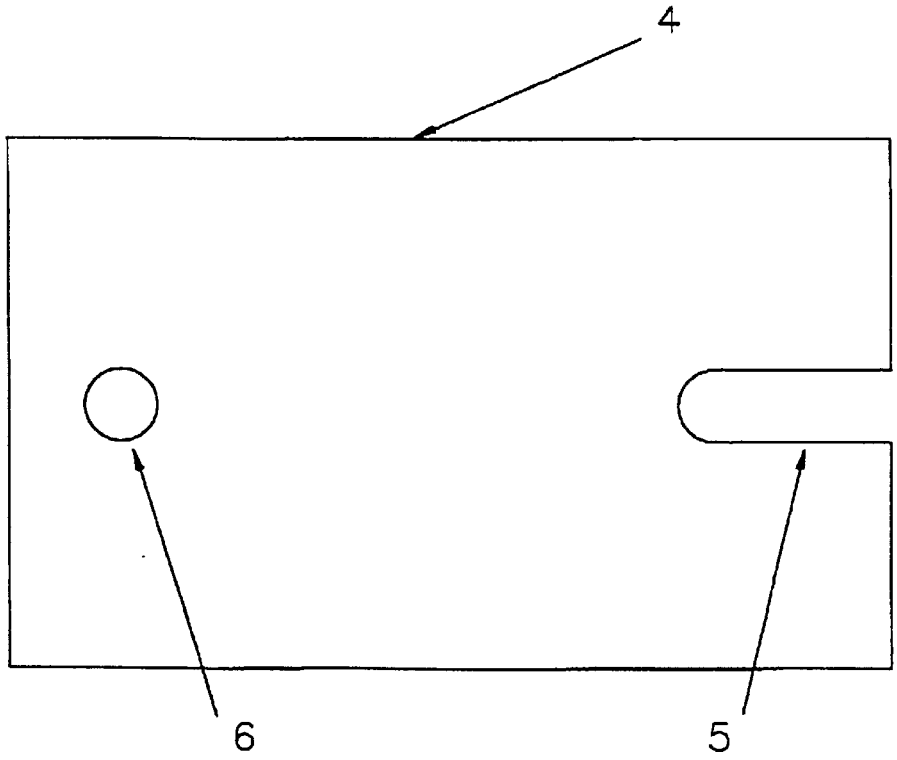
FIG. 3 is a plan view showing a rail support plate of the invention.

FIGS. 3 and 4 show a rail support plate 4. Rail support plate 4 has an open slotted hole 5 on its one side as shown to the right of FIGS. 3 and 4, and a hole 6 on its other side as shown to the left of these FIGS. 3 and 4. Hole 6 can be an open slotted hole similar to the open slotted hole 5.

Figure 5:
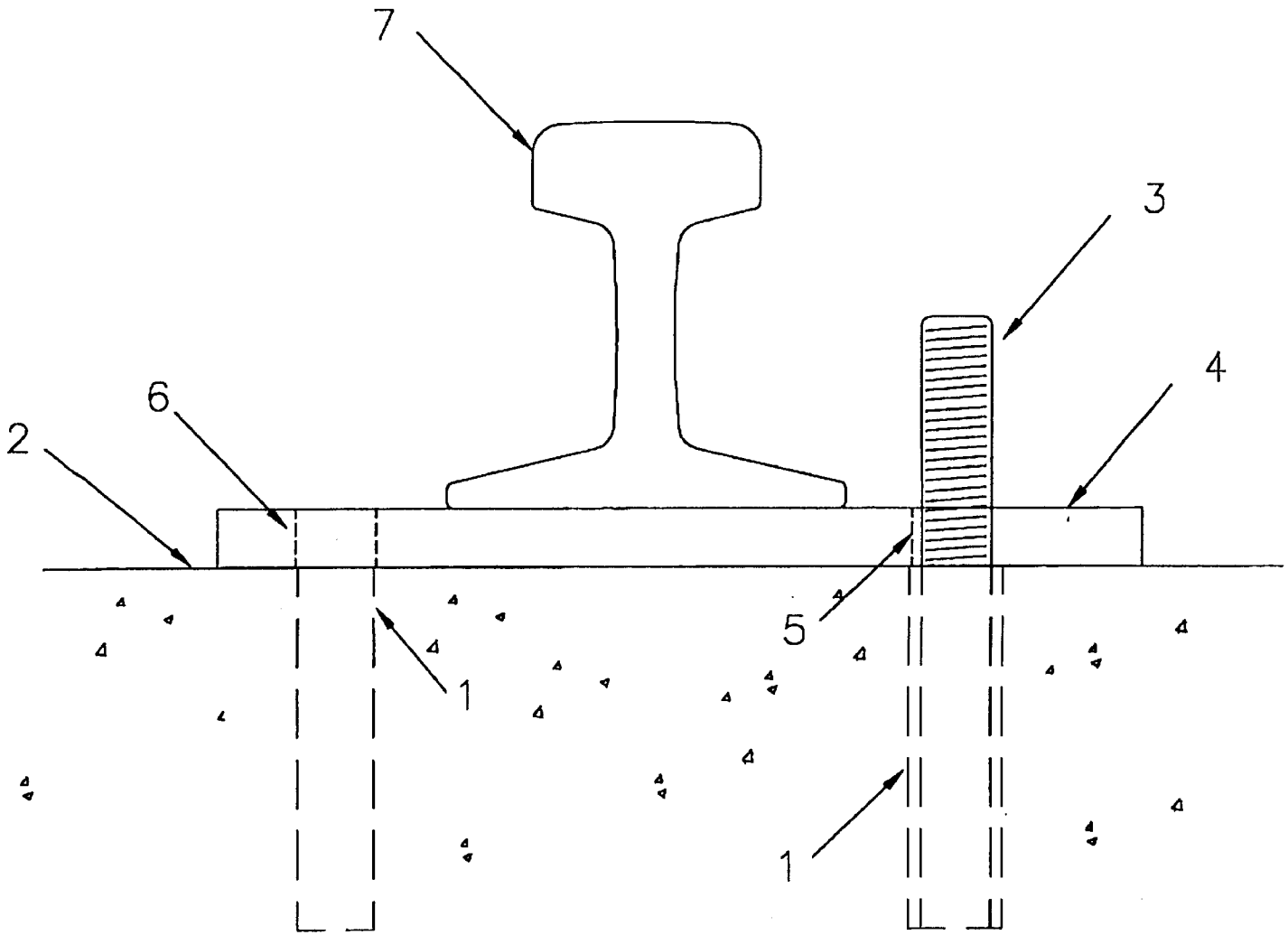
FIG. 5 is a view similar to FIG. 2 that further illustrates the positioning of the rail support plate of the invention underneath a rail.

FIG. 5 more clearly illustrates the placement of rail 7 onto rail support plate 4. The open slotted hole 5 in rail support plate 4 is in engagement with threaded anchor bolt 3, and hole 6 of rail support plate 4 is positioned over and concentrically aligned with open hole 1 of support structure 2. As shown in FIG. 5, drilled holes 1 are located on opposite sides of rail 7 along the edge of rail 7.

Figure 6:
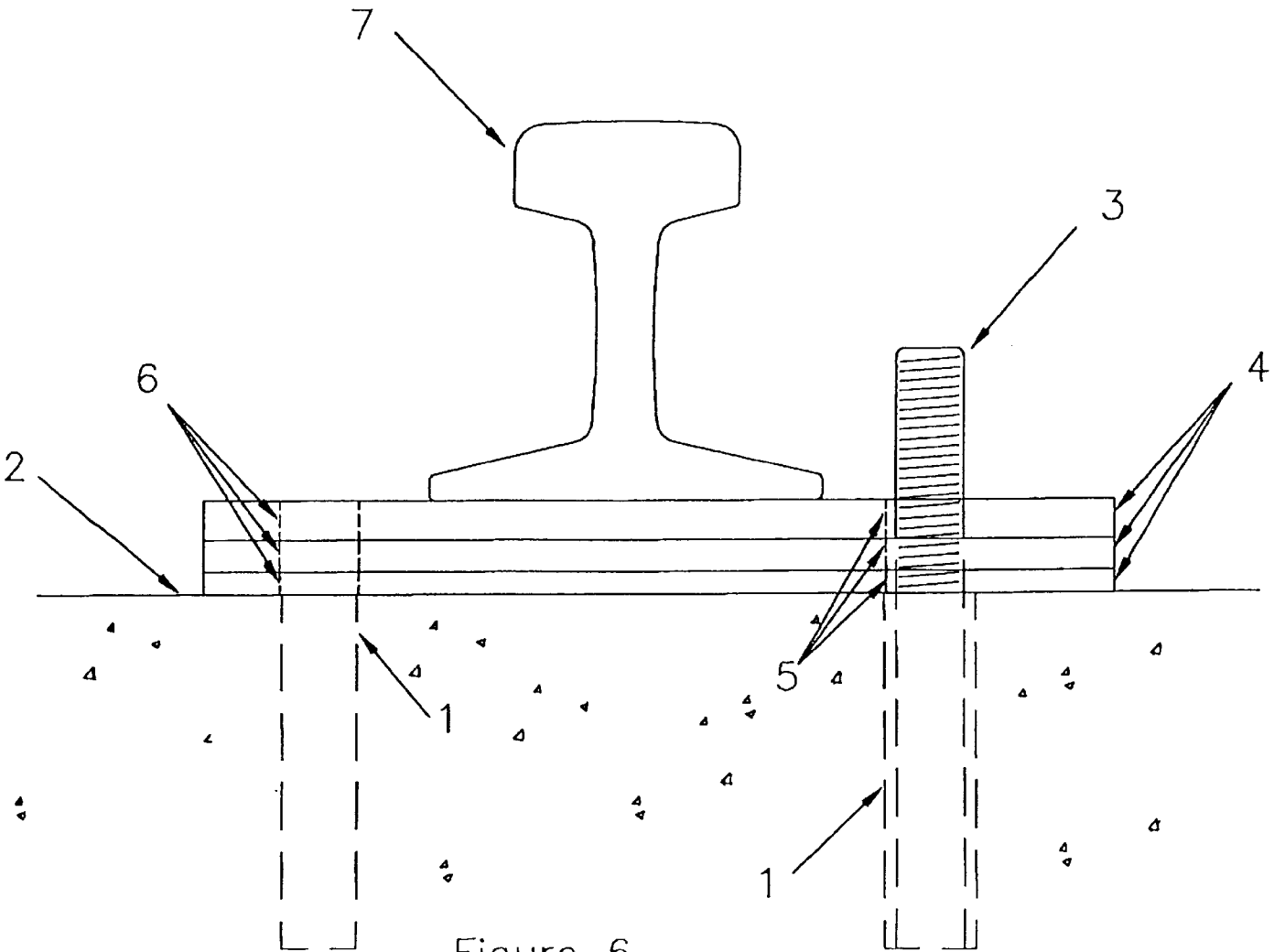
FIG. 6 is a view similar to FIG. 5 that illustrates the placement of several rail support plates with varying thickness underneath a rail.

FIG. 6 is similar to FIG. 5 but in addition shows several rail support plates 4. As shown in this Figure, these several rail support plates 4 have a different thickness. Depending on the required elevation of the rail 7, the thickness of the support plates 4 being used, and the gap between the underside of rail 7 and the upper surface of concrete support structure 2, one or more support plates 4 can be installed underneath rail 7 until the rail support plates 4 support rail 7. If more than one rail support plate 4 is needed under rail 7, then each rail support plate can be installed on the same threaded anchor bolt 3 which is received in the open slotted holes 5 of each rail plate 4. A securing bolt 9 (shown in FIG. 8) is inserted through hole 6 of each rail support plate 4 of FIG. 6.

Figure 7:
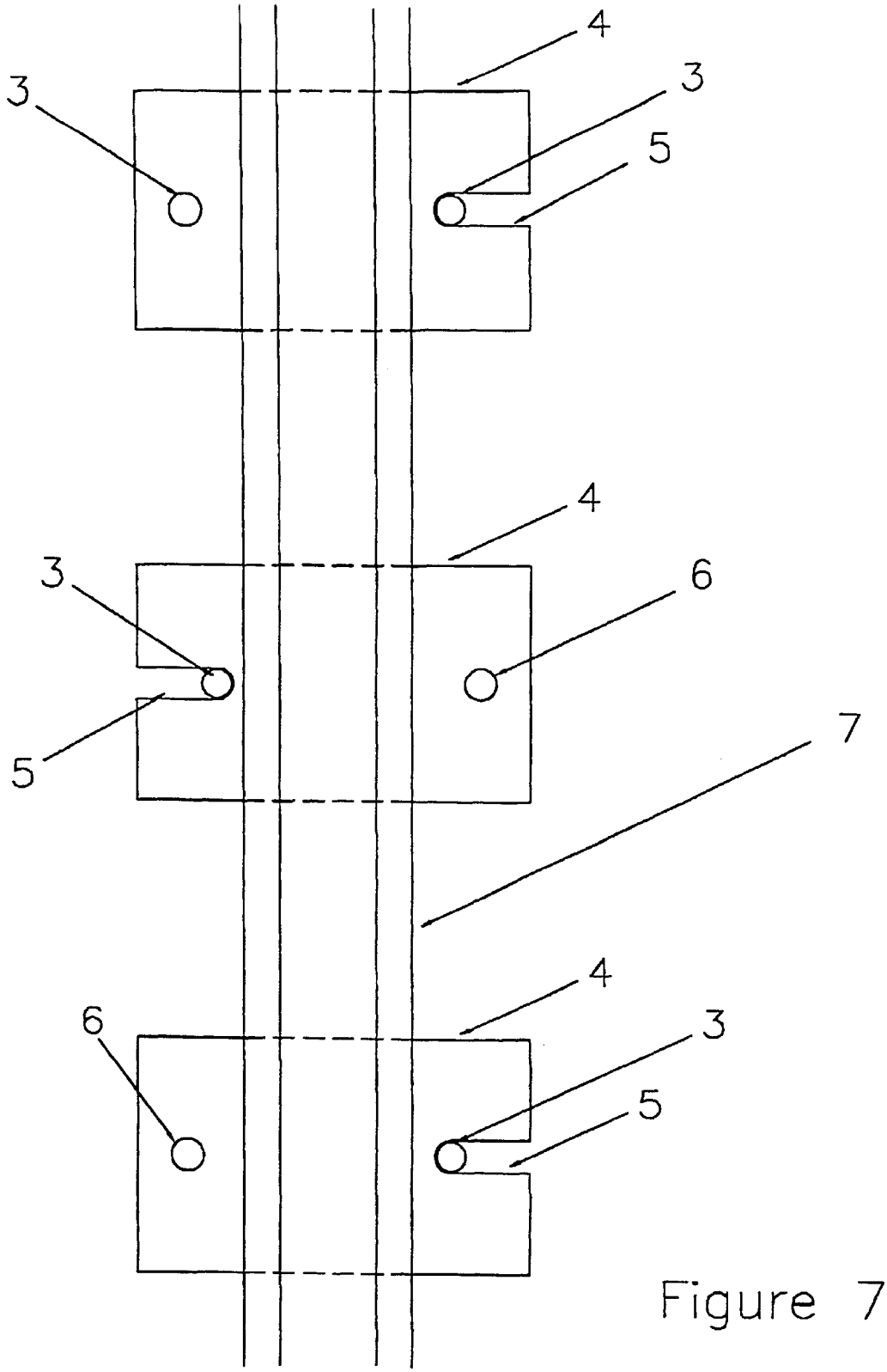
FIG. 7 is a plan view of FIG. 6 showing a staggered relationship of the holes and the open slotted holes of several rail support plates arranged along the length of a rail.

FIG. 7 illustrates several rail support plates 4 located at intervals along rail 7. These several rail support plates 4 of FIG. 7 can be spaced apart every 300 millimeters (11.8 inches) along rail 7 in order to more accurately control the elevation of rail 7. As shown in FIG. 7, threaded anchor 3 of each rail support plate 4 is arranged in a staggered pattern and secured into holes 1 of concrete support structure 2. Hole 1 on the other side of rail 7 is left open in order to receive a securing bolt similar to securing bolt 9 of FIG. 8. As stated herein above, both the anchor bolt 3 in its respective hole 1 and the open holes 1 can be cast into the concrete when support structure 2 is formed. In FIG. 7, threaded anchor bolt 3 associated with each rail support plate 4 is received in open slotted hole 5. Hole 6 of each rail support plate 4 is concentrically aligned over its cooperating hole 1 (FIG. 1) in preparation for receipt of a securing bolt similar to that shown at 9 in FIG. 8.

Figure 8:
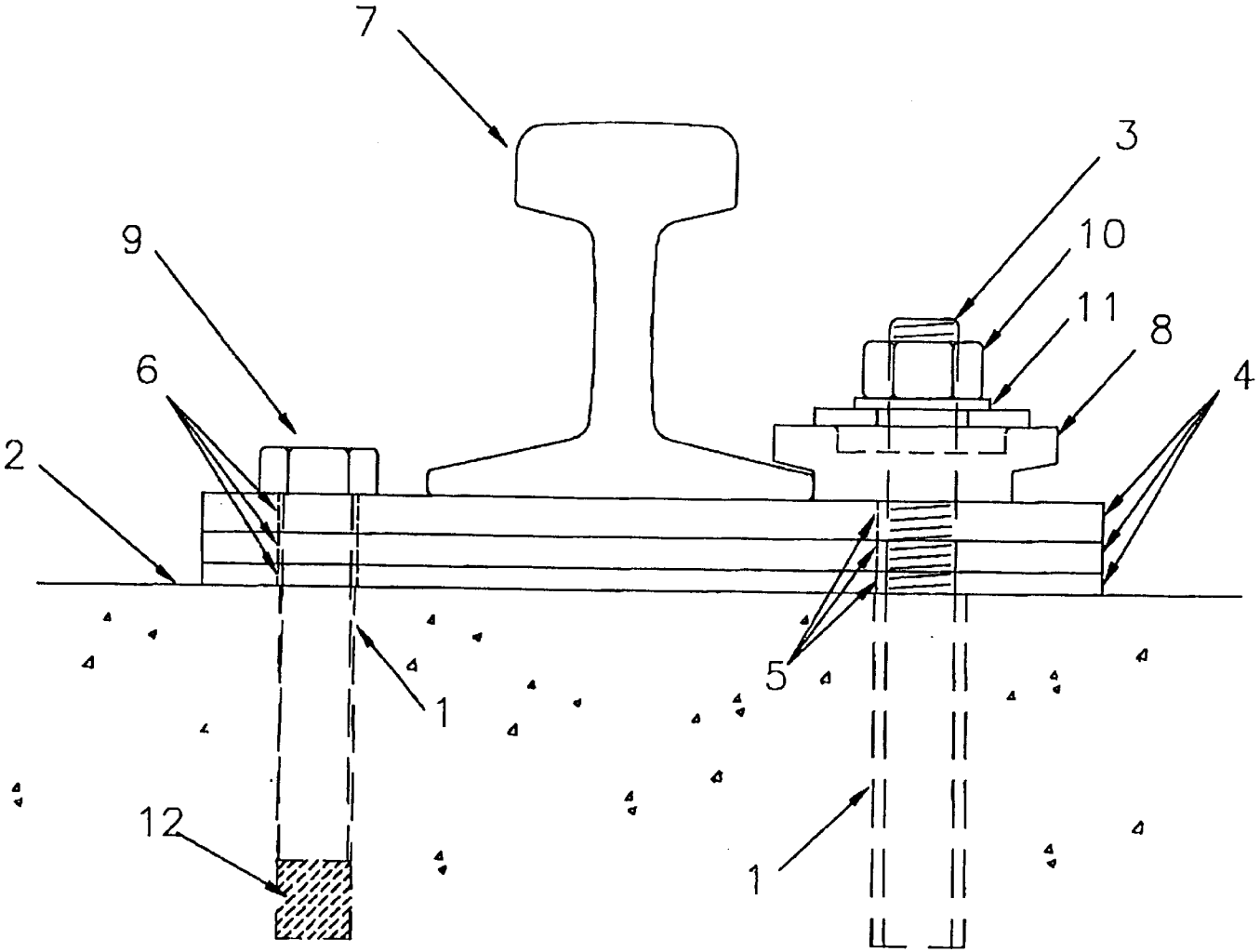
FIG. 8 is a section view similar to FIG. 6 showing the addition of a securing bolt and the addition of a rail clip secured to a threaded anchor bolt of a rail support plate.

FIG. 8 illustrates several rail support plates 4 of varying thickness and a rail clip 8 that is installed onto threaded anchor bolt 3. Rail clip 8 has surfaces that abut the edge of rail 8 and is adjustable to allow the lateral position of rail 8 to be altered. An example of rail clip 8 is commercially available and known to those skilled in the art. Rail clip 8 comprises a nut 10 and a washer 11, both of which are securely fastened onto threaded anchor bolt 3.

Still referring particularly to FIG. 8, a securing bolt 9 is passed through hole 6 of rail support plates 4 and into open hole 1 of concrete support structure 2. Securing bolt 9 is loosely held in hole 1 of support structure 2 by weight of the bolt. FIG. 8 shows caulking 12 that can be used to prevent the ingress of water into hole 1. This caulking 12 is inserted along the sides and base of hole 1.

Figure 9:
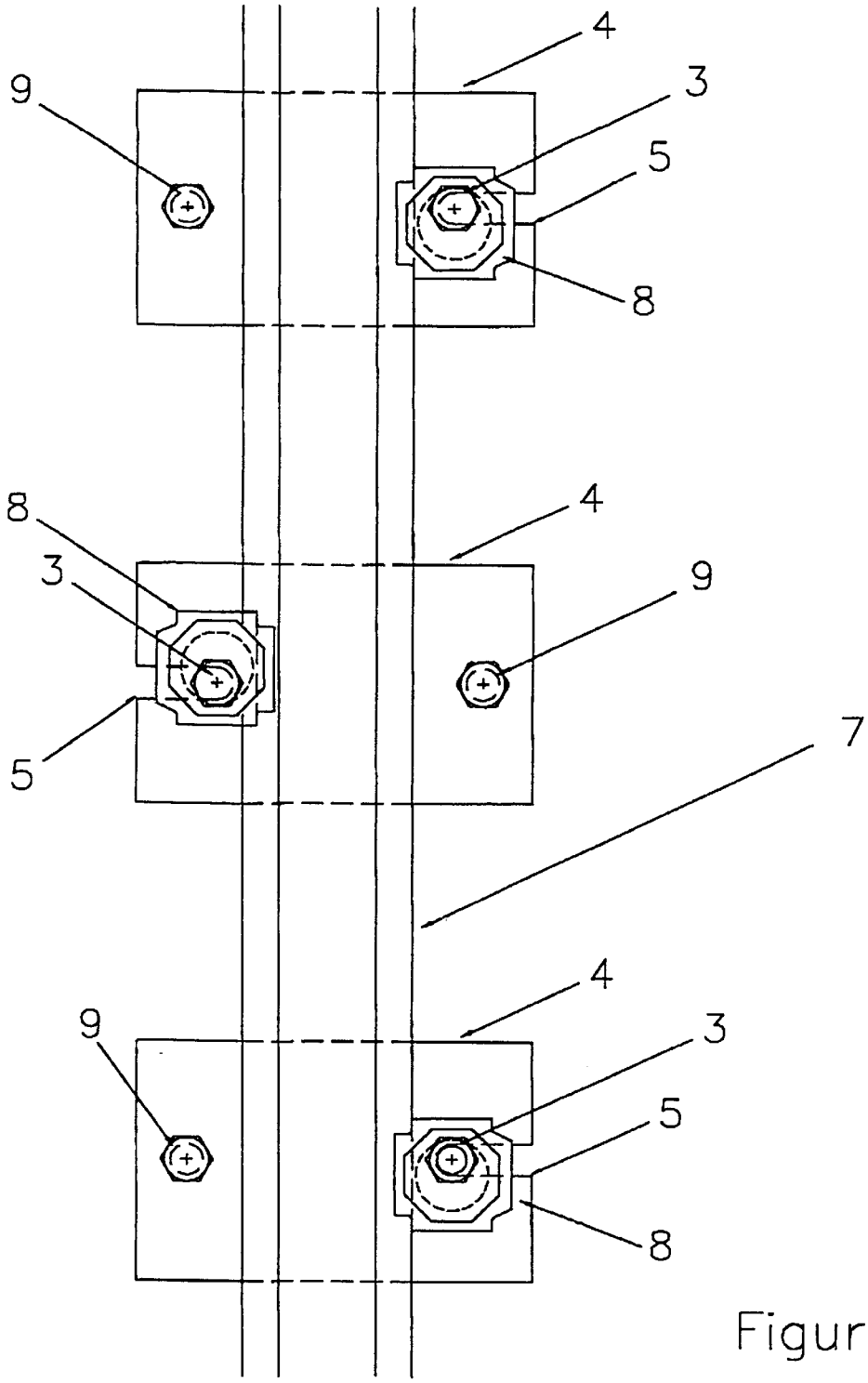
FIG. 9 is a plan view of FIG. 8 showing several spaced-apart rail support plates located along the length of a rail and a rail clip secured to the threaded anchor bolt of each rail support plate.

FIG. 9 shows several such arrangements of the rail support plates 4 and rail clips 8 selectively spaced along the length of rail 7. Here both the anchoring bolts 3 and the rail clips 8 of the plates 4 are staggered relative to each other along rail 7. This staggered and opposing relationship of rail clips 8 installed on anchor bolts 3, fix the lateral position of each rail 7. If adjustable rail clips 8 are installed, the lateral position of rail 7 can be altered to provide alignment.

The sequence for installing rail 7 onto concrete support structure 2 is as follows: Support structure 2 has drilled holes 1 and anchor bolts 3 permanently secured in its respective drilled hole 1 via grout, resin or expansion anchors, as shown in FIG. 2 and in the staggered pattern of FIG. 7. Rail 7 is positioned on temporary blocks and shims to its approximate proposed line and elevation. Rail support plates 4 are passed under rail 7 at several locations and the open slotted hole 5 and hole 6 of each plate 4 is positioned in alignment with holes 1 of support structure 2. Plates 4 of FIG. 7 are also positioned in a staggered pattern shown in FIG. 7 such that the open slotted hole 5 of each plate 4 engages its corresponding anchor bolt 3. Hole 6 of each plate 4 is then positioned over the open hole 1 in concrete support structure 2. A securing bolt 9 is then passed through hole 6 of plate 4 and into a cooperating aligned hole 1 of support structure 2.

Securing bolts 9 are loosely held in its respective hole 1 of support structure 2 by their own weight, and caulking 12 is installed in hole 1 to prevent water from entering the hole and collecting along the sides and base of hole 1 (FIG. 8). Support plates 4 are thus fixed in position relative to securing bolts 9, relative to rail 7, and relative to anchor bolts 3. The temporary blocks and shims are removed from under rail 7. Rail clips 8 of FIGS. 8 and 9 are then installed onto threaded anchors 3 and against rail 7. Washer 10 and nut 11 of each rail clip 8 are installed onto securing bolt 9 as shown particularly in FIG. 8, and then tightened against the rail clip, which, in turn, rests on rail support plate 4. Because anchor bolts 3 are staggered on either side of rail 7 and along the length of rail 7 (FIG. 9), rail clips 8 oppose one another and the rail is held in position laterally. If adjustable rail clips are installed on anchor bolts 3, these adjustable rail clips allow the lateral position of rail 7 to be changed.

If the elevation of rail 7 needs to be readjusted due, for instance, to foundation settlement of support structure 2, securing bolt 9 of the rail support plate or plates 4 can be removed, the nut on the anchor bolt loosened, and either a support plate 4 can be added or removed from under the rail, without the need to remove the rail.

As stated herein above, the thickness of a support plate 4 may vary to accommodate the required elevation of the rail 7 relative to support structure 2 or several support plates 4 may be used.

Even though a concrete support structure 2 is described herein, the support structure may be made of metal. This is particularly advantageous where access to the underside of a hole through the support structure is difficult. Even though one rail 7 is shown in the Figures, it is to be understood that two spaced-apart parallel rails can be provided wherein each rail has the arrangement of components shown in FIGS. 7–9.

While the present invention has been set forth in terms of specific embodiments thereof, it will be understood in view of the instant disclosure that numerous variations upon the invention are now enabled yet reside within the scope of the invention. Accordingly, the invention is to be broadly construed and limited only by the scope and spirit of the claims now appended hereto.

What is claimed is:

1. A rail support system, comprising:

at least one rail;

a concrete support structure for supporting said rail;

at least one set of opposed holes in said support structure, each of said holes located on an opposite side of said rail, and one said hole containing a permanently fixed anchor bolt that is cast into said concrete of said support structure;

at least one rail support plate having an open slotted hole on a first side that is opened along the periphery of said rail support plate and extends inwardly from said periphery of said rail support plate, and having a circular hole on a second side, said rail support plate positioned under said rail such that said open slotted hole of said rail support plate partially encircles said permanently fixed anchor bolt and said circular hole of said rail support plate is concentrically aligned with the other said hole in said support structure, a removable securing bolt received in said concentrically aligned holes for securing said rail support plate to said support structure; and a removable rail clip secured to said permanently fixed anchor bolt for securing said rail and said rail support plate to said support structure, said rail support plate being constructed to be installed and removed from under said rail without lifting said rail above said permanently fixed anchor bolt.

2. A rail support system of claim 1, comprising:

a plurality of said set of opposed holes in said support structure, each of said set containing an anchor bolt in one of said holes and a securing bolt in the other of said holes;

a plurality of said rail support plates positioned under and along the length of said rail, each of said rail support plates being secured to said support structure by way of an associated set of anchor and securing bolts, and a plurality of said rail clips, each of said rail clips associated with a cooperative anchor bolt of each of said rail support plates;

wherein said each anchor bolt with its respective rail clip is arranged in a staggered pattern relative to each other along the length of said rail.

3. A rail support system of claim 1, further comprising a stacked number of said rail support plates, and wherein said each of said rail support plates has the same thickness relative to each other.

4. A rail support system of claim 1, further comprising a stacked number of said rail support plates, and wherein said each of said rail support plates has a varied thickness relative to each other.

5. A rail support plate for use in a rail support system for supporting a rail, said rail support system having at least one set of opposed holes wherein one of said holes has an anchor bolt, said rail support plate comprising:

an open slotted hole on a first side that is opened along the periphery of said rail support plate and extends inwardly from said periphery of said rail support plate for partially encircling said anchor bolt when said rail support plate is positioned under said rail; and a circular hole on a second side for concentric alignment with the other of said holes for receiving a securing bolt for securing said rail support plate to said rail support system.

* * * * *